United States Patent [19]

Flower

[11] 4,137,044

[45] Jan. 30, 1979

[54] METHOD OF WASHING

[75] Inventor: David M. Flower, Grand Rapids, Mich.

[73] Assignee: Economics Laboratory, Inc., St. Paul, Minn.

[21] Appl. No.: 813,874

[22] Filed: Jul. 8, 1977

[51] Int. Cl.[2] ..... B08B 3/00

[52] U.S. Cl. ..... 8/137; 134/26; 252/8.9

[58] Field of Search ..... 8/137; 134/26, 35, 40; 252/8.9

[56] References Cited

U.S. PATENT DOCUMENTS

| | | | |
|---|---|---|---|
| 2,734,830 | 2/1956 | Hagge et al. | 8/137 |
| 2,965,678 | 12/1960 | Sundberg et al. | 8/137 |
| 3,505,004 | 4/1970 | Pfeil | 8/137 |
| 3,650,672 | 3/1972 | Swayn | 8/137 |
| 3,994,682 | 11/1976 | Braun | 8/137 |

*Primary Examiner*—William E. Schulz

*Attorney, Agent, or Firm*—Merchant, Gould, Smith, Edell, Welter & Schmidt

[57] ABSTRACT

A laundry method is disclosed including the step of laundering oil soiled fabric in lipophilic surfactant composition and subsequently laundering such fabric with a hydrophilic surfactant based detergent system.

18 Claims, No Drawings

METHOD OF WASHING

BACKGROUND OF THE INVENTION

The present invention relates to a method of washing and more particularly to a method of washing for removal of oil-type stains from fabrics.

The persistence of oil-type stains is a well recognized problem and a variety of approaches for reducing such stains to a minimum have been proposed. One commercially available approach for treating oily stains has been that of spraying certain high-foaming surfactants together with a solvent onto the soiled fabric. Commercially available products of this type include Prep™, Spray N'Wash™, and Shout™. Although such products may well be effective in removing oily stains, they are labor intensive when utilized. This is a problem with respect to large amounts of laundry having many soiled areas.

Another approach has been use of the presoak products which may include enzymes or high-foaming surfactants such as linear alkyl benzene sulfonates, alkyl ether sulfonates and the like. Such products require an extended soaking period and are therefore not completely satisfactory particularly for use in institutional laundries where high throughput is important.

A further approach has been to include highly alkaline materials as a prewash to remove loose soil materials. The highly alkaline materials do not adequately remove oily soils.

THE PRESENT INVENTION

The present invention relates to a laundering process in which the soiled fabric is first tumbled or washed in lipophilic surfactant or lipophilic blend of surfactants and subsequently tumbled or washed in a hydrophilic surfactant based detergent formulation. The washing takes place in an aqueous bath.

The process of the present invention may be used on various fabrics but is of particular value when seeking to remove oil stains from synthetic fabrics such as polyester. The fabric may be 100% polyester or may be a polyester blended with other materials such as cotton. In restaurant establishments doing their own laundry, on-premise, napkins and tablecloths are commonly a 50—50 blend of polyester and cotton. There is a strong affinity between polyester fabrics and oils which makes oils particularly difficult to remove from fabrics containing polyester.

Examples of lipophilic surfactants of the present invention are primary alcohol ethoxylates, secondary alcohol ethoxylates, alkylphenol ethoxylates and ethylene oxide/propylene oxide copolymers. The preferred primary and secondary alcohol ethoxylates are those having from 8 to 20 carbon atoms in the alcohol and an average of between 3 and 5 moles of ethylene oxide per mole of alcohol. The alcohol preferably is highly branched. More preferred primary or secondary alcohol ethoxylates have from 10 to 16 carbon atoms in the alcohol and from 3 to 5 moles of ethylene oxide per mole of alcohol. The preferred alkylphenol ethoxylates include nonylphenol ethoxylates, preferably having 1.5 to 5 moles of ethylene oxide per mole of nonylphenol.

Generally, with certain qualifications, HLB values can be used to classify surfactants as lipophilic or hydrophilic. For the purposes of this specification lipophilic surfactants can be divided into strong lipophilic surfactants which generally have an HLB value of 9 or less and intermediate lipophilic surfactants which usually have an HLB value of 9–11.

A good discussion of lipophilic and hydrophilic surfactants and the use of hydrophilic-lipophilic balance (HLB) numbers to classify surfactants can be found in Schick, Martin J., *SURFACTANT SERIES Volume I*, "Non-Ionic Surfactants" (Marcel Dekker, Inc., 1967) and Atlas Chemical Industries, Inc., *The ATLAS HLB SYSTEM a time-saving Guide to Emulsifier Selection*, (2nd Ed., 1961). The term lipophilic surfactant as used throughout this specification includes surfactants which have significant oil-solubilizing characteristics to emulsify oil and grease spots and thereby make them easier to remove from fabrics when used during the first step of the two-step washing process described herein.

Although HLB values are not a perfect measure of lipophilic behavior, they are believed to be the best objective measure available for predicting this behavior. The type of lipophilic and hydrophilic groups, the degree of branching, the molecular weight of the surfactant, etc. can also influence lipophilic behavior. Another reason why HLB values are not a perfect means of classification is because HLB values can be calculated or experimentally derived, meaning that more than one HLB value may be reported for an individual surfactant. In addition, alkylene oxide derived surfactants may have minor discrepancies in reported HLB values because the moles of alkylene oxide per molecule of surfactant is an average number and does not indicate the actual variation in the moles of alkylene oxide.

The hydrophilic detergent preferably is a relatively low-foam or low sudsing detergent. The hydrophilic detergent may be a non-ionic detergent which will solubilize or wash out oil stains treated with lipophilic surfactant and most of the residual lipophilic surfactant in the fabric. The hydrophilic detergent may, for example, be a high percentage ethylene oxide non-ionic detergent or such a non-ionic detergent in combination with an anionic detergent. The hydrophilic detergent may be used in an amount of about 0.25 to 1.0 ounce of active surfactant per 10 gallons of water used in the wash.

The temperatures used in the present process may include a temperature of between about 20° C and 70° C in the first washing step, preferably a minimum of about 40° C and a temperature of between about 40° C and 75° C in the second washing step, preferably about 60° C. The first wash time may vary with temperature, soil-load, design of machine, degree of mechanical agitation and other factors. The first wash time may vary from about 2 to 6 minutes. Longer times may be used but in institutional fabric washing the wash time is a compromise between obtaining good or acceptable results and rapid throughput since labor, machine, inventory and space tie-up are important economic considerations. The second wash time may be about 4 to 15 minutes, preferably 6 to 8 minutes, the various factors mentioned with respect to the first wash time being important.

The two step washing method of this invention improves oil removal from soiled fabric, improves the odor of laundered fabric by eliminating or decreasing rancid odors caused by oil spots, and improves the softness and antistatic properties of the laundered fabrics as more fully described in the following examples which illustrate the process of the present invention.

EXAMPLE #1

The present example illustrates the criticality of performing the present invention as two distinct steps, the first step being washing with a lipophilic surfactant and the second step being washing with a hydrophilic detergent.

To evaluate the performance of the two-step laundering process of this invention with respect to removal of oil stains, the following three laundering methods were carried out:

(1) The two-step method of the present invention comprising a first wash with lipophilic surfactant followed by a second wash with a commercially available laundry detergent;

(2) A two-step method comprising a first wash without the lipophilic surfactant followed by a second wash with the commercial laundry detergent; and (3) A two-step method comprising a first wash without lipophilic surfactant followed by a second wash with a combination of both a lipophilic surfactant and the commercial laundry detergent.

The tests were run on new, red polyester cotton fabric napkins which had been conditioned by washing them 20 times in a commercially available washing machine (25 LST Washmaster manufactured by Economics Laboratories, Inc.) using the standard recommended wash cycle and a commercially available nonionic surfactant based detergent (Fluff™). The detergent was used in the amount recommended on the container.

A conditioned test napkin was provided for each of the laundering methods. Each napkin had six identified zones. One of the zones was not stained and the remaining five zones were stained with corn oil. The staining was carried out by pre-spotting the conditioned napkins with hot (75–85° C) corn oil in one of the five zones and the spot was allowed to "age" for 15–20 minutes.

Each napkin was then run through a complete laundering cycle using the respective one of the aforedescribed three laundering methods. The napkins next were each pre-spotted in the second zone and laundered via the particular method. The staining-washing process was repeated until all five zones were stained. Thus, the napkin was washed five times after the first stain was applied, four times after the second stain, etc. to one washing after the fifth stain was applied. In other words, the napkin was washed a total of five times during the staining process.

The procedure for each laundering cycle was as follows:

| Function | Temperature | Time (Min.) | Water Level |
|---|---|---|---|
| First wash step | 43° C | 4 | High (15 gal.) |
| Drain/extract | — | 1.5 | — |
| Second wash step | 71° C | 8 | High |
| Drain | — | 1 | — |
| Bleach | 71° C | 6 | High |
| Drain | — | 1 | — |
| Rinse | 71° C | 1 | High |
| Drain | — | 1 | — |
| Rinse | 43° | 1 | High |
| Drain | — | 1 | — |
| Final rinse | 43° C | 3 | High |
| Drain/extract | — | 3 | — |

The five laundering cycles were the same within a given method.

Napkins, following each cycle, were visually rated by comparing them using the Deering Milliken Stain Release Chart, in AATCC Test Method 130-1969. This rating method uses a numerical rating of 1.0 to 5.0; 1.0 being equivalent to very poor removal (i.e. a dark oily spot); 5.0 being equivalent to total removal (i.e. no visible spot). Ratings were determined immediately after each wash cycle and after 24 hours for all three methods. Method #1 and Method #2 were tested twice and the average ratings for the two tests were determined.

Each of the five stain zones of the napkins were checked for odor following the complete five cycle test. The detergents or surfactants used during the first and second wash for each of the three laundering techniques tested were as follows:

| Method # | FIRST WASH STEP | SECOND WASH STEP |
|---|---|---|
| 1 | About 2 oz. of a lipophilic surfactant[1] (about 0.1%) in about 15 gallons of water | About 4.5 oz. of Detergent SL[2] (about 0.23%) and about 2.4 oz. of Fluff[3] (about 0.12%) in approximately 15 gallons of water |
| 2 | Water only | Same as above |
| 3 | Water only | Same as above plus about 2 oz. of lipophilic surfactant[1] (about 0.11%) |

[1]The lipophilic surfactant used was 25% secondary alcohol ethoxylate having from 11 to 15 carbon atoms in the alcohol and 5 moles of ethoxylate per mole of alcohol (product manufactured under the trademark of Tergitol 15-S-5 by Union Carbide Corporation) and 75% secondary alcohol ethoxylate having from 11 to 15 carbon atoms in the alcohol and 3 moles of ethoxylate per mole of alcohol (product manufactured under the trademark Tergitol 15-S-3 by Union Carbide Corporation).

[2]Trademark of Economic Laboratory, Inc. Detergent SL comprises alkaline builders, water conditioning agents, and a soil anti-redeposition agent.

[3]Trademark of Economics Laboratory, Inc. Fluff comprises about 18% of a hydrophilic non-ionic alcohol-based surfactant, in combination with anti-redeposition agents and optical brightening agents. Thus about 2.4 oz. of Fluff contains about 0.4 oz. of active surfactant.

The process of the present invention (Method #1) which used a lipophilic surfactant in the first wash step and a hydrophilic detergent in the second wash step gave the following results:

| Area Number | Number Of Times Stain Was Laundered | Initial Rating First Test | Initial Rating Second Test | Initial Rating Ave. | Rating After 24 Hours First Test | Rating After 24 Hours Second Test | Rating After 24 Hours Ave. |
|---|---|---|---|---|---|---|---|
| 1 | 5 | 5.0 | 5.0 | 5.0 | 5.0 | 5.0 | 5.0 |
| 2 | 4 | 5.0 | 5.0 | 5.0 | 5.0 | 5.0 | 5.0 |
| 3 | 3 | 5.0 | 5.0 | 5.0 | 5.0 | 5.0 | 5.0 |
| 4 | 2 | 4.0 | 5.0 | 4.5 | 5.0 | 5.0 | 5.0 |
| 5 | 1 | 3.0 | 4.0 | 3.5 | 4.0 | 4.5 | 4.5 |

A light oily odor was noted in Area 5 (the area which had been washed only once) following the completed test. The other four areas were odor free.

The process in which no lipophilic surfactant was used in either wash step and only the hydrophilic detergent was used in the second step (Method #2) gave the following results:

| Area Number | Number Of Times Stain Was Laundered | Initial Rating First Test | Initial Rating Second Test | Initial Rating Ave. | Rating After 24 Hours First Test | Rating After 24 Hours Second Test | Rating After 24 Hours Ave. |
|---|---|---|---|---|---|---|---|
| 1 | 5 | 5.0 | 4.5 | 5.0 | 5.0 | 4.5 | 5.0 |
| 2 | 4 | 5.0 | 3.5 | 4.5 | 5.0 | 3.5 | 4.5 |
| 3 | 3 | 4.0 | 3.0 | 3.5 | 4.0 | 3.0 | 3.5 |
| 4 | 2 | 3.0 | 2.0 | 2.5 | 3.0 | 2.0 | 2.5 |
| 5 | 1 | 1.0 | 1.0 | 1.0 | 1.0 | 1.0 | 1.0 |

A heavy rancid odor was noted following completion of the test in the zones receiving 1, 2 and 3 launderings after staining (i.e. the areas which had gone through three or less cycles).

The process in which no surfactant was used in the first step and lipophilic surfactant was used in the second wash step in combination with the hydrophilic detergent (Method #3) gave the following results:

| Area Number | Number of Times Stain Was Laundered | Initial Rating | Rating After 24 Hours |
|---|---|---|---|
| 1 | 5 | 4.0 | 5.0 |
| 2 | 4 | 3.0 | 5.0 |
| 3 | 3 | 3.0 | 5.0 |
| 4 | 2 | 2.0 | 4.0 |
| 5 | 1 | 2.0 | 4.0 |

A heavy rancid odor was noted on all five areas following the completed test.

The process of the present invention (Method #1) was found superior to the other two methods tested. The use of lipophilic surfactant in the same wash step with a hydrophilic detergent (Method #3) gave poorer oil stain removal results than using no lipophilic surfactant (Method #2). Thus, a lipophilic surfactant in a first wash step followed by a hydrophilic detergent in a second wash step improves oil removal while the use of the same lipophilic surfactant mixed with the commercial hydrophilic detergent appears to impede the removal of oil stains. Even after only one washing cycle the two-step method of the present invention (Method #1) is superior to the other two methods to which it was compared in removing oil stains (average rating of 3.5 vs. ratings of 1.0 and 2.0). After 24 hours, the napkins washed with lipophilic surfactant (Methods #1 and #3) improved in appearance. This phenomonon may be due to absorption of moisture due to surfactant remaining on the surface of the napkin.

The method of the present invention was also superior to the methods it was tested against for eliminating rancid odors caused by oily stains.

EXAMPLE #2

Several additional lipophilic surfactants were tested using the two-step laundering method and hydrophilic surfactant of Example #1. The method of evaluation was the same as Example #1. That is, napkins were divided into six areas. The oil stain in area 1 was washed 5 times, the oil stain in area 2 was washed 4 times, etc. The results are divided by surfactant type. Table 1 lists the results of tests using various Linear Secondary Alcohol Ethoxylates. Table 2 lists the results of tests using various Linear Primary Alcohol Ethoxylates. Table 3 lists the results of tests using various Nonyl Phenol Ethoxylates. Table 4 lists the results of tests using various other surfactants.

TABLE 1

LINEAR SECONDARY ALCOHOL ETHOXYLATES

| Surfactant | Trade Name | Typical HLB* | RATING Area 1 | Area 2 | Area 3 | Area 4 | Area 5 |
|---|---|---|---|---|---|---|---|
| None | — | — | 4.5 | 3.5 | 3.0 | 2.0 | 1.0 |
| $C_{11}$–$C_{15}$ linear, secondary alcohol 3 mole ethoxylate | Tergitol[1] 15-S-3 | 8.0–9.0 | 5.0 | 5.0 | 5.0 | 5.0 | 4.5 |
| $C_{11}C_{15}$ linear, secondary alcohol 5 mole ethoxylate | Tergitol[1] 15-S-5 | 10.5–10.9 | 5.0 | 5.0 | 5.0 | 5.0 | 4.5 |
| $C_{11}$–$C_{15}$ linear, secondary alcohol 7 mole ethoxylate | Tergitol[1] 15-S-7 | 12.1–12.8 | 4.0 | 3.5 | 3.0 | 2.0 | 1.0 |
| $C_{11}$–$C_{15}$ linear, secondary alcohol 9 mole ethoxylate | Tergitol[1] 15-S-9 | 13.8 | 5.0 | 5.0 | 4.0 | 2.0 | 1.0 |

[1]Trademark of Union Carbide Corporation

*The value is listed as typical since it was usually not indicated in the technical literature whether the HLB value listed was calculated or experimental. A range is listed where different values were listed in different technical literature.

TABLE 2

LINEAR PRIMARY ALCOHOL ETHOXYLATES

| Surfactant | Trade Name | Typical HLB* | RATING Area 1 | Area 2 | Area 3 | Area 4 | Area 5 |
|---|---|---|---|---|---|---|---|
| None | — | — | 4.5 | 3.5 | 3.0 | 2.0 | 1.0 |
| $C_{12}$—$C_{15}$ linear, primary alcohol, 3 mole etoxylate | Neodol[2] 25-3 | 7.8 | 5.0 | 3.0 | 3.0 | 2.0 | 2.0 |
| $C_{12}$—$C_{15}$ linear, primary alcohol, 3 mole ethoxylate | Tergitol[1] 25-L-3 | 7.7 | 5.0 | 5.0 | 5.0 | 5.0 | 4.5 |
| $C_{12}$—$C_{13}$ linear, primary alcohol, 3 mole ethoxylate | Neodol[2] 23-3 | 8.1 | 4.5 | 4.5 | 4.0 | 4.0 | 3.0 |
| $C_{12}$—$C_{15}$ linear, primary alcohol, 5 mole ethoxylate | Tergitol[1] 25-L-5 | 10.4 | 4.5 | 4.0 | 3.5 | 3.0 | 2.5 |

[1]Trademark of Union Carbide Corporation

[2]Trademark Shell Chemical Company, Division of Shell Oil Company

*The value is listed as typical since it was usually not indicated in the technical literature whether the HLB value listed was calculated or experimental.

TABLE 3

NONYL PHENOL ETHOXYLATES

| Surfactant | Trade Name | Typical HLB* | RATING Area 1 | Area 2 | Area 3 | Area 4 | Area 5 |
|---|---|---|---|---|---|---|---|
| None | — | — | 4.5 | 3.5 | 3.0 | 2.0 | 1.0 |
| Nonylphenol ethoxylate 1.5 mole | Igepal[1] CO-210 | 4.6 | 5.0 | 5.0 | 5.0 | 5.0 | 5.0 |
| Nonylphenol ethoxylate 4 mole | Igepal[1] CO-430 | 8.8 | 5.0 | 5.0 | 5.0 | 5.0 | 4.0 |

TABLE 3-continued

| NONYL PHENOL ETHOXYLATES | | | RATING | | | | |
|---|---|---|---|---|---|---|---|
| Surfactant | Trade Name | Typical HLB* | Area 1 | Area 2 | Area 3 | Area 4 | Area 5 |
| Nonylphenol ethoxylate 4 mole | Surfonic[2] N-40 | 8.9 | 5.0 | 5.0 | 5.0 | 5.0 | 4.5 |
| Nonylphenol ethoxylate 5 mole | Igepal[1] CO-520 | 10.0 | 5.0 | 5.0 | 5.0 | 5.0 | 4.5 |
| Nonylphenol ethoxylate 6 mole | Igepal[1] CO-530 | 10.8 | 2.0 | 2.0 | 2.0 | 2.0 | 2.0 |

[1]Trademark of General Aniline and Film Corporation
[2]Trademark of Jefferson Chemical Co., Inc.
*The value is listed as typical since it was usually not indicated in the technical literature whether the HLB value listed was calculated or experimental.

TABLE 4

| OTHER SURFACTANTS | | | RATING | | | | |
|---|---|---|---|---|---|---|---|
| Surfactant | Trade Name | Typical HLB* | Area 1 | Area 2 | Area 3 | Area 4 | Area 5 |
| None | — | — | 4.5 | 3.5 | 3.0 | 2.0 | 1.0 |
| Ethylene oxide-propylene oxide block copolymer | Pluronic[1] L-42 | 8.0 | 5.0 | 5.0 | 5.0 | 4.5 | 3.5 |
| Ethoxylated castor oil | Trylox[2] CO-16 | 9.7 | 5.0 | 5.0 | 4.0 | 3.0 | 1.0 |
| Ethoxylated hydrogenated castor oil | Trylox[2] HCO-16 | 8.4 | 5.0 | 4.0 | 3.5 | 2.0 | 1.0 |
| Polyethylene glycol 400 dioleate | Emerest[3] 2648 | 8.5 | 4.5 | 4.0 | 3.0 | 2.0 | 1.0 |

[1]Trademark of Wyandotte Chemicals Corporation
[2]Trademark of Trylon Chemical Corporation
[3]Trademark of Emery Industries, Inc.
*The value is listed as typical since it was usually not indicated in the technical literature whether the HLB value listed was calculated or experimental.

As indicated in Table 1, the two-step laundering method of this invention utilizing a strongly lipophilic (HLB value of 9 or less) Linear Secondary Alcohol Ethoxylate or an intermediately lipophilic (HLB value of 9–11) Linear Secondary Alcohol Ethoxylate showed substantially improved oil stain removal when compared to a conventional one-step laundering method. When Linear Secondary Alcohol Ethoxylates with an HLB value above 11 were used in the two-step laundering of this invention, oil stain removal was comparable or slightly better than a conventional one-step laundering method.

As indicated in Table 2, the two-step laundering method of this invention utilizing a strongly or an intermediately lipophilic Linear Primary Alcohol Ethoxylate showed improved oil stain removal when compared to a conventional one-step laundering method.

As indicated in Table 3, the two-step laundering method of this invention utilizing a lipophilic Nonylphenol Ethoxylate with from 1.5 to 5 moles of ethylene oxide showed substantially improved oil stain removal when compared to a conventional one-step laundering method.

As indicated in Table 4, the two-step laundering method of this invention, utilizing various additional lipophilic surfactants, outperformed a conventional one-step laundering method with respect to oil stain removal. While the two-step washing method of this invention utilizing Ethoxylated Hydrogenated Castor Oil (Trylox™ JCO-16) and Polyethylene glycol 400 dioleate (Emerest™ 2648) did not perform as well as the same method using most of the other surfactants described above, it did out perform the conventional one-step laundering method.

As indicated by Tables 1–4, there is not a perfect correlation between HLB value and performance rating. As previously suggested, this is because HLB is only one of several criteria which can be used in characterizing a surfactant; other important factors include the degree of branching, the type of lipophilic and hydrophilic groups present, and the molecular weight of the surfactant. While HLB is not a perfect measure of performance, the testing which has been tabulated herein indicates that an HLB value of 10.5–11.0 or less, generally indicates that the surfactant, when used in the two-step laundering method of this invention, will improve oil stain removal when compared to a conventional one-step technique.

EXAMPLE #3

A field test was conducted at a restaurant to determine the effectiveness of the washing process of this invention for removing oil stains from 45-inch tablecloths (a 50–50 blend of polyester-cotton fabric).

Each tablecloth was evaluated for oil stains prior to beginning the test and after various intervals of time thereafter. The percentage of the total area of each tablecloth that was stained was estimated and an average area stained was determined for each group of tablecloths being evaluated. For example, the pre-test evaluation was as follows for ten gold colored tablecloths:

| TABLE CLOTH # | AREA STAINED | APPEARANCE |
|---|---|---|
| 1 | 10% | small spots |
| 2 | 15% | small spots |
| 3 | 15% | small spots |
| 4 | 25% | 15 spots |
| 5 | 50% | 25 spots |
| 6 | 10% | small spots |
| 7 | 35% | 1 large spot/few small spots |
| 8 | 10% | small spots |
| 9 | 15% | 1 large spot |
| 10 | 30% | 25 small spots |

The average area stained being calcuated to be 21.5%.

Two sets of tablecloths were evaluated: one set was gold in color and the other red in color. The tablecloths used had been in normal restaurant use prior to the test. The washing was carried out by restaurant personnel using their usual washing procedure with the addition of an initial lipophilic surfactant wash prior to the hydrophilic wash cycle.

The lipophilic surfactant used in this example was a mixture of 25% Tergitol 15-S-5 and 75% Tergitol 15-S-3 as in Example 1. (Tergitol is a trademark of Union Carbide Corporation).

During the test about 17 gallons of water were used per wash load. During the first ten weeks of the test, 5 oz. of the liphophilic surfactant (about 0.23%) were used per wash load. After the first ten weeks, the amount of lipophilic surfactant was reduced to 3 oz. (about 0.14%) per wash load.

| Length of Test (amount of lipophilic detergent added) | Number | Average Area Stained (Red Tablecloths | Number | Average Area Stained (Gold Tablecloths |
|---|---|---|---|---|
| Initial evaluation | 10 | 29% | 10 | 21.5% |
| After 8 days (5oz./load) | 6 | 13% | 7 | 4% |
| After 4 weeks (5oz./load) | 10 | 5% | 8 | 5.5% |
| After 5½ weeks (5oz./load) | 9 | 3.9% | 10 | 6.5% |
| After 8 weeks (5oz./load) | 10 | 3.5% | 10 | 6.0% |
| After 10 weks (5oz./load) | 8 | 6.2% | 7 | 5.7% |
| After 11 weeks (3oz./load) | 10 | 5% | 10 | 9.5% |
| After 13 weeks (3oz./load) | 10 | 3.5% | 10 | 6.0% |
| After 15 weeks (3oz./load) | 14 | 3% | 14 | 9.3% |
| After 20 weeks (3oz./load) | 10 | 11% | 8 | 6% |
| After 24 weeks (3oz./load) | 10 | 7.5% | — | — |

The average area stained was reduced significantly after eight days and remained at a reduced level throughout the test.

It was also noted that the tablecloths had a heavy rancid odor before the present processing and that after four weeks the odor was substantially reduced.

EXAMPLE #4

A second field test similar to the one described in Example #3 was conducted. The procedure and evaluation technique were essentially the same except that the test was conducted with red napkins and 4 oz. of lipophilic surfactant was added to 15 gallons of water. Although all napkins were washed using the present process, only a random sampling of the napkins were evaluated for stains.

The results were as follows:

| Length of Test | Number of Napkins | Average Area Stained |
|---|---|---|
| Initial Evaluation (pre-test) | 15 | 25.7% |
| After 5 days | 10 | 33% |
| After 11 days | 20 | 24.5% |
| After 3 weeks | 20 | 11% |
| After 6 weeks | 20 | 7% |
| After 8 weeks | 20 | 10% |
| After 10 weeks | 19 | 5.3% |
| After 12 weeks | 10 | 7% |
| After 19 weeks | 20 | 3% |
| After 21 weeks | 20 | 4.3% |

These results show a significant reduction in the average area stained after three weeks of washing using the process of the present invention. The results continued to improve through the remainder of the test. It is believed that there was not an immediate reduction in the average stained area since an "induction period" was needed to remove the "set" stains and a period of time was probably required to get all of the inventory of napkins into use and washed.

A heavy rancid grease odor was present on the napkins prior to the beginning of the test. After three weeks the rancid odor was substantially reduced.

EXAMPLE #5

A test was conducted to compare, in a commercial environment, the results of removing oil and grease stains from soiled restaurant napery using 1) the two-step laundering techniques of this invention and 2) a conventional laundering procedure. All washing was carried out in a commercially available laundry machine (Washmaster 90 LST manufactured by Economics Laboratory, Inc.) under substantially identical conditions. All napery was new at the beginning of the test and was subjected to normal usage at a restaurant throughout the test period. Prior to initiating the test, the napery was divided into a Control Group and an Experimental Group. One corner of each piece of napery in the Control Group was marked for identification purposes. Throughout the test, a given piece of napery remained in its original group, however, the groups were not segregated at the restaurant but were mixed and randomly used.

Approximately 22 gallons of water were used per wash load. The lipophilic surfactant was the same as that used in Example 1.

The napery items in the Experimental Group were washed using the technique of this invention via the following procedure:

| Time | Function | Products | Water Temperature |
|---|---|---|---|
| 4 min. | First wash step | 6 oz. lipophilic surfactant (about 0.21%) | 43° C(110° F) |
| 1 min. | Drain | — | — |
| 8 min. | Second wash step | 9.5 oz. Detergent SL™ (about 0.34%) 3 oz. Fluff™ (about 0.11%) | 43° C |
| 1 min. | Drain | — | — |
| 6 min. | Bleach | 3.5 oz. Destrainer[1] (about 0.12%) | 43° C |
| 1 min. | Drain | — | — |
| 2 min. | Rinse | — | 43° C |
| 1 min. | Drain | — | — |
| 2 min. | Rinse | — | 43° C |
| 1 min. | Drain | — | — |
| 3 min. | Final Rinse | 1.5 oz. Neutralizer[2] (about 0.05%) 1.5 oz. Liquid Soft[3] (about 0.05%) | 43° C |
| 2 min. | Extract | — | — |
| ½ min. | Shakeout | — | — |

[1]Trademark of Economics Laboratory, Inc. Destrainer comprises liquid sodium hypochlorite and was used at a level to yield approximately 100 ppm available chlorine in solution.

[2]Trademark of Economics Laboratory, Inc. Neutralizer is an acid neutralizer used to neutralize the residual alkalinity in the final rinse.

[3]Trademark of Economics Laboratory, Inc. Liquid Soft is a quaternary ammonium fabric softening product containing optical brighteners.

The items in the Control Group were washed following the same procedure except that the first wash and the first drain steps were eliminated. In other words, the procedure began with the 8 min. wash.

Results wre tabulated by counting the number of stained items after each laundering. The number of stains per item or the intensity of a stain were not considered. It was found that the stains remaining after laundering were generally of two types - cigarette or cigar ash (apparently from using napkins to wipe out ash trays) and oil or grease type stains. Neither method was found superior for removing ash type stains. The results with respect to oil and grease stains were as follows:

| Length of Test | Item | Control Group: Number Washed | Control Group: Number With Oil or Grease Stain | Experimental Group: Number Washed | Experimental Group: Number With Oil or Grease Stain |
|---|---|---|---|---|---|
| After 1 day | Napkins | 118 | 4 | 172 | 0 |
| | Tablecloths | 5 | 0 | — | — |
| After 2 days | Napkins | 178 | 3 | 142 | 0 |
| After 6 days | Napkins | 183 | 41 | 114 | 1 |
| | Tablecloths | 14 | 2 | 4 | 0 |
| After 12 days | Napkins | 177 | 26 | 263 | 1 |
| | Tablecloths | 15 | 1 | 16 | 0 |
| After 13 days | Napkins | 120 | 10 | 88 | 0 |
| TOTALS | Napkins | 776 | 84 | 779 | 2 |
| | Tablecloths | 34 | 3 | 20 | 0 |
| Percent Stained: | Napkins | | 10.82% | | 0.26% |
| | Tablecloths | | 8.82% | | 0.00% |

The results show the laundry process of this invention (Experimental Group) was far superior to the conventional laundry process (Control Group) for removing oil and grease stains from table napery.

During the above-described test a somewhat "slick" feel and a general darkening was noticed among the items in the Experimental Group. A lack of foam in the second wash step was also noticed. It was hypothesized that these phenomena were due to retention and carry over of the lipophilic surfactant. Whether or not these could be considered negative factors was not determined.

To lessen the carryover of product from the first wash step a ½ to 1 minute intermediate extract step was added just prior to the second wash step and the above-described test was continued for an additional period of time. The results were as follows.

| Length of Test | Item | Control Group: Number Washed | Control Group: Number With Oil or Grease Stain | Experimental Group: Number Washed | Experimental Group: Number With Oil/Grease Stain |
|---|---|---|---|---|---|
| After 18 days | Napkins | 60 | 7 | 138 | 0 |
| After 21 days | Napkins | — | — | 39 | 0 |
| | Tablecloths | — | — | 1 | 0 |
| After 22 days | Napkins | 373 | 55 | 194 | 0 |
| | Tablecloths | 16 | 2 | 10 | 0 |
| After 23 days | Napkins | 148 | 53 | 109 | 0 |
| | Tablecloths | 3 | 0 | 3 | 0 |
| After 26 days | Napkins | 319 | 108 | 280 | 5 |
| | Tablecloths | 5 | 0 | 2 | 0 |
| After 27 days | Napkins | 92 | 43 | 90 | 0 |
| After 30 days | Napkins | 272 | 144 | 285 | 4 |
| After 33 days | Napkins | 88 | 45 | 29 | 1 |
| After 37 days | Napkins | 137 | 89 | 158 | 2 |
| TOTALS: | Napkins | 1489 | 544 | 1322 | 12 |
| | Tablecloths | 24 | 2 | 16 | 0 |
| Percent Stained: | Napkins | | 36.53% | | 0.91% |
| | Tablecloths | | 8.33% | | 0.00% |

The results demonstrated the superiority of the process of this invention in removing oil and grease stains from table naperies.

The addition of the extract step after the prewash and before the wash cycle, reduced the "slick" feel of the naperies and increased the foam height in the wash cycle.

To determine if the older oil stains could be removed from the control napery both the Control and the Experimental Groups were washed using the previously described two-wash step process of this invention. The results were as follows:

| Length of Test | Item | "Ex-Control" Group: Number Washed | "Ex-Control" Group: Number With Oil or Grease Stain | Experimental Group: Number Washed | Experimental Group: Number With Oil or Grease Stain |
|---|---|---|---|---|---|
| After 1 day* | Napkins | 83 | 8 | 45 | 1 |
| After 2 days* | Napkins | 92 | 5 | 106 | 2 |
| After 3 days* | Napkins | 182 | 7 | 179 | 7 |
| TOTALS | Napkins | 357 | 20 | 330 | 10 |
| Percent Stained: | | | 5.6% | | 3.0% |

*During the three-day period each napkin was washed once or twice each day.

While the staining rate for the "Ex-Control" Group was not as low as that of the Experimental Group, a considerable improvement occurred.

EXAMPLE #6

The present example illustrates that the two-step washing method of the present invention imparts improved antistatic properties to naperies washed thereby compared to a conventional one-step washing method. The test described herein was designed to measure the propensity of fabrics to generate static electricity as they are dried in a machine dryer. The importance of minimizing the build up of static electricity during drying is at least two-fold. First, if too much static electricity is allowed to build up the machine operator may receive an electrical shock when unloading the machine and during the subsequent folding of the naperies. Second, the static cling within and between the naperies makes it difficult to remove the pieces from the dryer and to fold them for storage. Laundry items which do not fold well also take up more storage room.

The test fabrics were 54 inch by 54 inch tablecloths made of 50% dacron and 50% cotton. The tablecloths were divided into an "Experimental" and a "Control" Group, each group consisting of 14 tablecloths. The "Control" Group was not washed with a lipophilic surfactant. The "Experimental" Group was pre-conditioned to simulate an "in-use" situation by washing the tablecloths in the group 10 times via the two-step method of this invention using 4 oz. of the lipophilic surfactant described in Example #1 per 7 lb. load of tablecloths and following the two-step laundering method as set out in Example #1.

The "Control" and "Experimental" Groups of tablecloths were then dried for approximately 1 hour using Kenmore Dryer Model #7208611W set at high temperature (set to peak at 160° F), heavy fabric, and super speed.

To measure the build up of static electricity an insulated stainless steel probe one-quarter inch in diameter, containing an electrostatic sensor, had previously been inserted one and one-quarter inches into the dryer through the opening in the center of the dryer door and connected to a Honeywell Electronic 194 Voltage Meter and Recorder equipped with Honeywell Recording Paper No. 680000-1. The Meter was set to the 2 volt scale and the chart speed was set at 2 minutes per inch. The Recorder was turned on just prior to starting the dryer.

The relative degree of static electricity generated during drying was determined by determining the intensity of the electricity generated by counting the number of times the recorder pen travel exceeded one inch on either side of the zero line per six minute interval. Eight-six minute intervals were evaluated for both the "Experimental" and the "Control" Groups. During approximately the first six minutes of drying time for the "Experimental" Group a tablecloth apparently became wrapped around the probe of the electrostatic sensor due to overloading and caused obviously inaccurate readings. Three tablecloths were removed to eliminate the problem, leaving 14 in the dryer. Fourteen tablecloths were then used when the "Control" Group was dried. The first six minute interval of the "Experimental" Group is thus not included in the table set out below. The results were as follows:

| SIX MINUTE INTERVALS | COUNT* CONTROL GROUP | EXPERIMENTAL GROUP |
|---|---|---|
| 1 | 0 | — |
| 2 | 21 | 13 |
| 3 | 10 | 1 |
| 4 | 57** | 0 |
| 5 | 93** | 0 |
| 6 | 108** | 0 |
| 7 | 173** | 0 |
| 8 | 130** | 0 |
| 9 | 129** | 0 |

*The number of times the pen travel exceeded one inch on either side of the zero line per the indicated six minute interval.
**Estimates since the density of the lines made it very difficult to determine the exact number of times the pen exceeded one inch on either side of the zero line.

As indicated by the above table, the tablecloths which had previously been washed by the two-step method of this invention ("Experimental" Group) showed much better resistance to static electricity build-up than tablecloths which had not ("Control" Group).

I claim:

1. A multi-step process for laundering oil soiled fabric, said process comprising:
   laundering said fabric in a first aqueous bath including a lipophilic surfactant which imparts oil-solubilizing characteristics to said first aqueous bath,
   separating said fabric from said first aqueous bath,
   laundering said fabric in a second hydrophilic aqueous bath including hydrophilic detergent and,
   separating said fabric from said second hydrophilic aqueous bath.

2. The process of claim 1 wherein said lipophilic surfactant is a linear alcohol ethoxylate, said alcohol having from about 8 to about 20 carbon atoms and said ethoxylate being present in an average amount of between about 3 and about 5 moles per mole of linear alcohol.

3. The process of claim 2 wherein said linear alcohol ethoxylate has an HLB value of up to about 11.

4. The process of claim 3 wherein said HLB value is a calculated HLB value.

5. The process of claim 3 wherein said HLB value is an experimentally determined HLB value.

6. The process of claim 2 wherein said linear alcohol ethoxylate is a highly branched primary alcohol ethoxylate.

7. The process of claim 2 wherein said linear alcohol is a secondary alcohol ethoxylate.

8. The process of claim 7 wherein said secondary alcohol ethoxylate has from 10 to 16 carbon atoms in the alcohol group.

9. The process of claim 1 wherein said hydrophilic detergent comprises a non-ionic detergent.

10. The process of claim 1 wherein said lipophilic surfactant is an alkylphenol ethoxylate, said alkylphenol having about 8 to 13 carbon atoms in the alkyl radical and an average of 1.5 to 5 moles of ethylene oxide per mole of alkyl phenol.

11. The process of claim 10 wherein said alkyl phenol ethoxylate is a nonylphenol ethoxylate.

12. The process of claim 11 wherein said nonylphenol ethoxylate has an HLB value of up to about 10.5.

13. The process of claim 12 wherein said HLB value is a calculated HLB value.

14. The process of claim 12 wherein said HLB value is an experimentally determined HLB value.

15. The process of claim 1 wherein said lipophilic surfactant has an HLB value of up to about 10.5.

16. The process of claim 15 wherein said HLB value is a calculated HLB value.

17. The process of claim 15 wherein said HLB value is an experimentally determined HLB value.

18. A multi-step process for laundering oil soiled fabric, said process comprising:

laundering said fabric in a first aqueous bath including a lipopholic surfactant, which lipophilic surfactant has an HLB value of up to about 10.5 and which imparts oil solubilizing characteristics to said first aqueous bath, separating said fabric from said first aqueous bath, laundering said fabric in a second non-ionic hydrophilic detergent and, separating said fabric from said second non-ionic hydrophilic aqueous bath.

* * * * *

UNITED STATES PATENT AND TRADEMARK OFFICE

CERTIFICATE OF CORRECTION

PATENT NO. : 4,137,044

DATED : January 30, 1979

INVENTOR(S) : David M. Flower

It is certified that error appears in the above-identified patent and that said Letters Patent are hereby corrected as shown below:

Column 3, line 56, for "43°" read --43° C--.
Column 4, line 25, for "Economic" read --Economics--.
Column 6, line 5, for "phenomonon" read --phenomenon--.
Column 9, after line 17, insert --The test results were as follows:--.
Column 11, line 1, for "wre" read --were--.
Column 15, line 10, for"lipopholic" read --lipophilic--.

Signed and Sealed this

*Eleventh* Day of *September 1979*

[SEAL]

*Attest:*

*Attesting Officer*

LUTRELLE F. PARKER

*Acting Commissioner of Patents and Trademarks*